US012696966B2

(12) United States Patent
Liang

(10) Patent No.: US 12,696,966 B2
(45) Date of Patent: Aug. 4, 2026

(54) ATOMIZING COMB

(71) Applicant: CF Pharmtech USA, Inc., County of Sussex, DE (US)

(72) Inventor: Bill Wenqing Liang, Suzhou (CN)

(73) Assignee: CF Pharmtech USA, Inc., County of Sussex, DE (US)

( * ) Notice: Subject to any disclaimer, the term of this patent is extended or adjusted under 35 U.S.C. 154(b) by 29 days.

(21) Appl. No.: 18/845,247

(22) PCT Filed: Aug. 30, 2023

(86) PCT No.: PCT/CN2023/115662
§ 371 (c)(1),
(2) Date: Sep. 9, 2024

(87) PCT Pub. No.: WO2024/051542
PCT Pub. Date: Mar. 14, 2024

(65) Prior Publication Data

US 2025/0261735 A1 Aug. 21, 2025

(30) Foreign Application Priority Data

Sep. 8, 2022 (CN) ..... 202222392189.6

(51) Int. Cl.
*A45D 24/22* (2006.01)
*A45D 24/10* (2006.01)

(52) U.S. Cl.
CPC ..... *A45D 24/22* (2013.01); *A45D 24/10* (2013.01); *A45D 2200/057* (2013.01)

(58) Field of Classification Search
CPC ..... A45D 24/22; A45D 24/10
See application file for complete search history.

(56) References Cited

U.S. PATENT DOCUMENTS 1,252,499 A * 1/1918 Scheel ..... A45D 24/22 401/28
2,176,736 A * 10/1939 Geria ..... A45D 24/22 219/214

(Continued)

FOREIGN PATENT DOCUMENTS

CN 205963268 U 2/2017
CN 106889736 A 6/2017

(Continued)

OTHER PUBLICATIONS

Supplementary European Search Report for Application No. 23862237.7 dated Mar. 21, 2025. 5 pages.

(Continued)

*Primary Examiner* — Nicholas D Lucchesi
(74) *Attorney, Agent, or Firm* — Lerner David LLP

(57) ABSTRACT

An atomizing comb comprises a main body internally provided with a channel for passing mist; comb teeth connected to the main body; and a box removably connected to an outside of the main body and comprising a bottle and an atomizing device. In the present invention, the active ingredients in the care solution effectively penetrates into the scalp, hair roots and hair tips, with particles of 5 to 10 micron in size. Finer particles will form more uniform adhesion and deeper penetration, leading to faster effectiveness. Through combing the hair with the comb teeth, the hair is fully dispersed to create spaces, so that the tiny droplets penetrate into the hair through the comb teeth, and the active ingredients in the care solution are fully and evenly transferred from the patient's scalp and hair roots to the hair tips, solving problems of the scalp, hair follicles, hair roots and hair.

14 Claims, 2 Drawing Sheets

(56) References Cited

U.S. PATENT DOCUMENTS

| | | | | |
|---|---|---|---|---|
| 2,381,048 | A * | 8/1945 | Habostad | A45D 24/22 D28/21 |
| 3,429,642 | A * | 2/1969 | Underwood | A45D 24/22 132/148 |
| 4,585,018 | A * | 4/1986 | O'Connor | A01K 13/003 401/268 |
| 5,076,298 | A * | 12/1991 | Busch | A45D 24/22 401/47 |
| 6,588,964 | B1 * | 7/2003 | Au | A61H 7/003 401/28 |
| 10,631,625 | B1 * | 4/2020 | Alhajji | A45D 24/22 |
| 2002/0153020 | A1 * | 10/2002 | Fiore | A45D 24/22 132/114 |
| 2003/0029468 | A1 * | 2/2003 | Choi | A45D 24/22 132/116 |
| 2004/0011370 | A1 * | 1/2004 | Vena | A45D 24/22 132/116 |
| 2005/0155981 | A1 * | 7/2005 | Abe | A45D 24/22 222/105 |
| 2009/0320868 | A1 * | 12/2009 | Wang | A45D 24/26 132/112 |
| 2011/0315157 | A1 * | 12/2011 | Mercier | A45D 19/026 132/112 |
| 2013/0133678 | A1 * | 5/2013 | Nakashima | A45D 24/24 401/196 |
| 2015/0101630 | A1 * | 4/2015 | Kodama | A45D 24/26 132/200 |
| 2015/0157108 | A1 * | 6/2015 | Roberts | A45D 24/22 132/116 |
| 2015/0265025 | A1 * | 9/2015 | Alsalameh | A45D 24/28 132/113 |
| 2017/0251783 | A1 * | 9/2017 | Grez | A45D 24/26 |
| 2017/0367455 | A1 * | 12/2017 | Enrique | A45D 24/22 |
| 2018/0271267 | A1 * | 9/2018 | Velasquez | A45D 24/28 |
| 2021/0015234 | A1 * | 1/2021 | De Araujo | A61K 8/735 |
| 2024/0115025 | A1 * | 4/2024 | Charraud | A45D 19/00 |
| 2024/0358134 | A1 * | 10/2024 | Short | A45D 24/22 |
| 2025/0009104 | A1 * | 1/2025 | Wu | A45D 24/28 |
| 2025/0057723 | A1 * | 2/2025 | Long | A45D 34/04 |

FOREIGN PATENT DOCUMENTS

| | | | |
|---|---|---|---|
| CN | 206675198 | U | 11/2017 |
| CN | 108143074 | A | 6/2018 |
| CN | 209898574 | U | 1/2020 |
| CN | 112603789 | A | 4/2021 |
| CN | 112716765 | A | 4/2021 |
| CN | 113712365 | A | 11/2021 |
| CN | 114916765 | A | 8/2022 |
| CN | 217185135 | U | 8/2022 |
| CN | 218278928 | U | 1/2023 |
| GB | 2591325 | A | 7/2021 |
| WO | 2009065747 | A1 | 5/2009 |
| WO | 2017043777 | A1 | 3/2017 |
| WO | 2023062560 | A1 | 4/2023 |

OTHER PUBLICATIONS

International Search Report for Application No. PCT/CN2023/115662 mailed Sep. 22, 2023, 3 pages.

Denmark Search Report for Application No. BA202400062 mailed May 15, 2025, 2 pages.

* cited by examiner

ATOMIZING COMB

CROSS-REFERENCE TO RELATED APPLICATIONS

The present application is a U.S. National entry under 35 U.S.C. § 371 of International Application No. PCT/CN2023/115662, filed Aug. 30, 2023, which claims the benefit of, and priority to Chinese Patent Application No. 202222392189.6 filed on Sep. 8, 2022 in the China National Intellectual Property Administration, the disclosures of which are hereby incorporated by reference in its entirety.

PRIORITY

The present PCT application claims the priority of the CN application No. 202222392189.6 filed on Sep. 8, 2022, and the technical solution of said CN application is incorporated into the present application by reference.

TECHNICAL FIELD

The present application relates to an atomizing comb, which belongs to the field of personal care, beauty and health.

BACKGROUND

There are many problems with current hair and scalp health care products. Due to the blocking of hair, spray-type products cannot deliver the active ingredients of the care solution evenly and effectively, and require multiple tools to be cooperated together. They are not only ineffective, but also not convenient to use.

In addition, hair dryers and hair straightening devices can cause damage to hair, and such devices are large, consume a lot of power, which are not portable, and inconvenient to use. There is no product on the market that can be portable, power-saving, and efficient enough to satisfy many users who have high demands on their hair and scalp issues as well as their personal appearance.

SUMMARY

The purpose of the present invention is to provide an atomizing comb that delivers the active ingredients of the care solution from the scalp and hair roots to the hair tips in extremely small particle sizes through misting, thereby solving the problems of the user's scalp, hair follicles, hair roots and hair tips.

In order to address the above technical problem, the present invention provides the following technical solutions:

The present invention provides an atomizing comb, comprising:

- a main body, wherein the main body is internally provided with a channel for passing mist;
- comb teeth, wherein the comb teeth are connected to the main body; and
- a box for producing the mist, wherein the box is removably connected to an outside of the main body, and the box comprises a bottle and an atomizing device.

In an embodiment of the present invention, the bottle is filled with liquid, and the atomizing device is used to disperse the liquid in the bottle into tiny droplets and spray them through the channel.

In an embodiment of the present invention, the box further comprises a nozzle, the nozzle is connected to the bottle, and the liquid in the bottle is dispersed into tiny droplets and sprayed out through the nozzle and the channel.

In an embodiment of the present invention, the bottle is filled with liquid, and the atomizing device is used to disperse the liquid in the bottle into tiny droplets and spray them through the channel and the comb teeth.

In an embodiment of the present invention, the box further comprises a cotton core, wherein one end of the cotton core is connected to the bottle, the other end of the cotton core is connected to the atomizing device, and the cotton core is used for transferring the liquid in the bottle to the atomizing device.

In an embodiment of the present invention, the box further comprises a nozzle, the nozzle is connected to the bottle, and the liquid in the bottle is dispersed into tiny droplets and sprayed out through the nozzle, the channel and the comb teeth.

In an embodiment of the present invention, the main body is removably connected to the box through a connecting mechanism, and the channel of the main body is in communication with the nozzle.

In an embodiment of the present invention, the comb teeth comprise a base and several teeth connected to the base, the teeth are internally provided with hollow cavities, and the base is provided with several spraying holes, wherein both the hollow cavities and the spraying holes are in communication with the channel.

In an embodiment of the present invention, the box further comprises power contacts and positioning magnets.

In an embodiment of the present invention, the main body further comprises a power button and a charging contact.

In an embodiment of the present invention, the comb teeth are connected to a comb teeth cover; the main body is connected to a box cover, and the box is located within the box cover.

In an embodiment of the present invention, the atomizing device is a ceramic atomizing piece.

The beneficial effects of the present invention are as follows:

(1) In the present invention, the active ingredients in the care solution effectively penetrates into the scalp, hair roots and tips with particles of 5 to 10 micron in size. Finer particles will form more uniform adhesion and deeper penetration, leading to faster effectiveness.

(2) In the present invention, through the process of combing the hair with the comb teeth, the hair is fully dispersed to create spaces, so that the tiny droplets can penetrate into the hair through the comb teeth, and the active ingredients in the care solution can be fully and evenly transferred from the patient's scalp and hair roots to the hair tips, solving many problems on the patient's scalp, hair follicles, hair roots and hair.

(3) In the present invention, a compact and portable use scenario is realized through a low power consumption ceramic atomizing piece, which can meet the demand for use anytime and anywhere.

Figure 1:
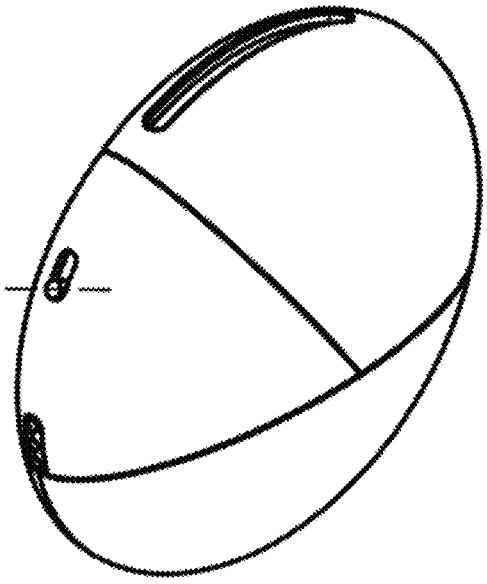
FIG. 1 is a three-dimensional view of an atomizing comb of the present invention.

In the drawing, 1. Box cover; 2. Box for producing mist; 3. Main body; 4. Comb teeth; 5. Comb teeth cover; 6. Bottle;

7. Atomizing device; 8. Cotton core; 9. Nozzle; 10. Connecting mechanism; 11. Channel for passing the mist; 12. Power button; 13. Charging contact; 14. Power contact; 15. Positioning magnet.

DETAILED DESCRIPTION OF THE EMBODIMENTS

The technical solution of the present invention will be further described in detail below with reference to the accompanying drawings and embodiments. It is understood that the specific embodiments described herein are only to explain the present invention, but not to limit the present invention. It should also be noted that, for ease of description, the accompanying drawings show only part of, but not all of, the structures associated with the present invention.

In the present invention, the terms "communicated" "connected" and "fixed" are to be understood in a broad sense, for example it may be a fixed connection, a removable connection, or a one-piece connection; it may be a mechanical connection, an electrical connection; it may be a direct connection, or an indirect connection through an intermediate medium; or there may be a communication within two elements or an interaction between the two elements. For those of ordinary skills in the art, the specific meaning of the above terms in the context of the present invention can be understood according to specific cases.

In the present invention, unless otherwise expressly specified or defined, a first feature "above" or "under" a second feature may include a direct contact between the first and second features, or may include a contact between the first and second features through another feature between them. Furthermore, the first feature "above" "over" and "on top of" the second feature simply indicates that a horizontally height of the first feature is higher than that of the second feature. The first feature "below", "under" and "on bottom of" the second feature simply indicates that horizontally height of the first feature is lower than that of the second feature.

Embodiment 1

Figure 2:
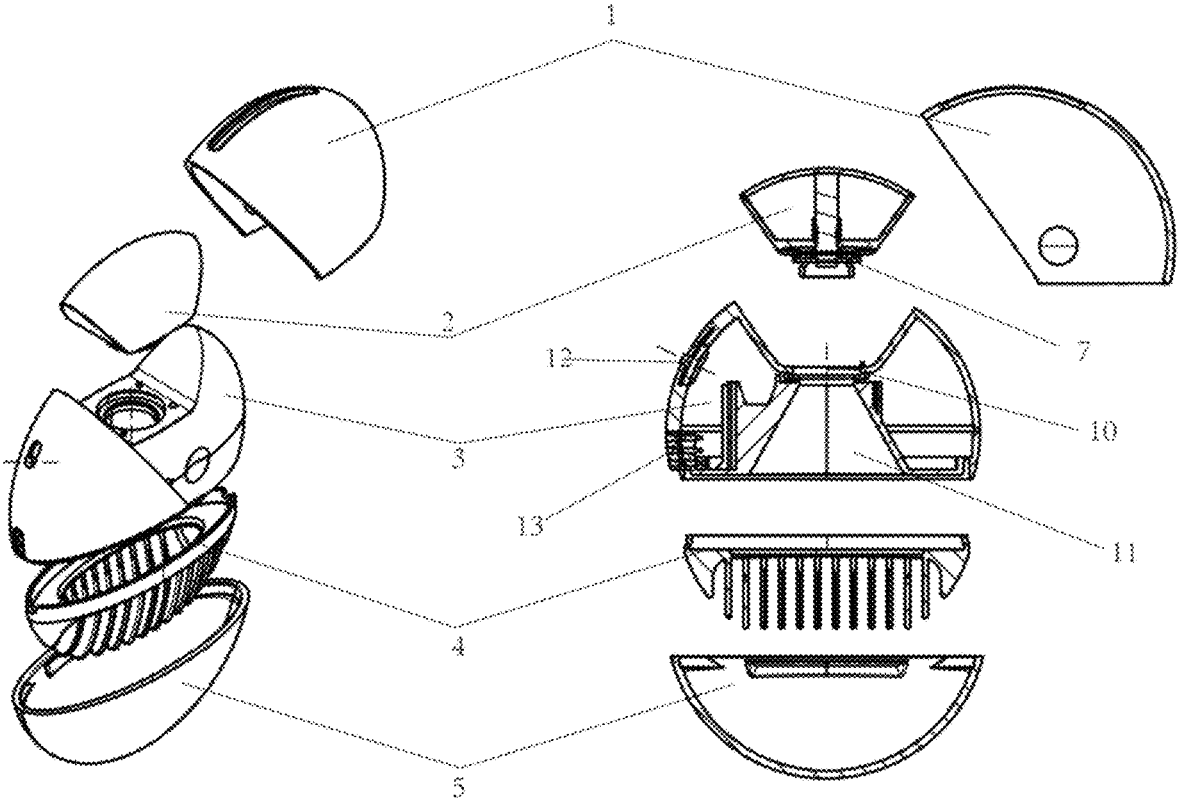
FIG. 2 is an exploded view of the atomizing comb of the present invention.
Figure 3:
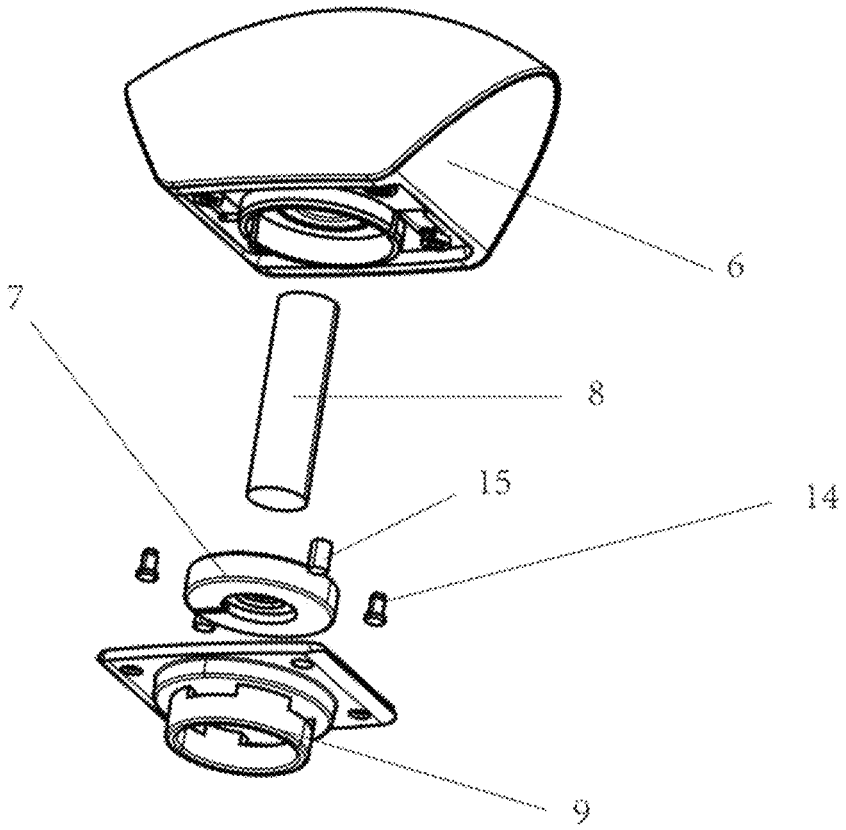
FIG. 3 is an exploded view of a box containing liquid of the present invention.

An atomizing comb, as shown in FIGS. 1 to 3, comprises a box 2 for producing mist (i.e., a box containing liquid), a main body 3, and comb teeth. The main body 3 is internally provided with a channel 11 for passing the mist. The comb teeth 4 are connected to the main body 3. The box 2 is removably connected to an outside of the main body 3, and the box 2 is located at an outside of the channel 11. The box 2 comprises a bottle 6 and an atomizing device 7, wherein the bottle 6 is filled with liquid for caring of hair and scalp, and the atomizing device 7 is used to disperse the liquid in bottle 6 into tiny droplets and spray them through the channel 11. Further, the atomizing device 7 is used to disperse the liquid in bottle 6 into tiny droplets and spray them through the channel 11 and the comb teeth 4. Through the process of combing the hair with the comb teeth 4, the hair is fully dispersed to create spaces, so that the tiny droplets can penetrate into the hair through the comb teeth 4, and the active ingredients in the care solution can be fully and evenly transferred from the patient's scalp and hair roots to the hair tips, solving many problems on the patient's scalp, hair follicles, hair roots and hair.

As shown in FIG. 3, the box 2 also comprises a cotton core 8 and a nozzle 9. One end of the cotton core 8 is connected to the bottle 6, and the other end is connected to the atomizing device 7. The cotton core 8 is used for transferring the liquid in the bottle 6 to the atomizing device 7. The nozzle 9 is connected to the bottle 6, and the liquid in the bottle 6 is dispersed into tiny droplets and sprayed out through the nozzle 9 and the channel 11; further, the liquid in the bottle 6 is dispersed into tiny droplets and sprayed out through the nozzle 9, the channel 11 and the comb teeth 4.

Further, the main body 3 is removably connected to the box 2 through a connecting mechanism 10, and the channel 11 of the main body 3 is in communication with the nozzle 9. The box 2 also comprises power contacts 14 and positioning magnets 15. The box 2 is positioned relative to the main body 3 through the positioning magnets 15, and power is supplied to the atomizing device 7 through the power contacts 14.

Further, the main body 3 comprises a power button 12 and a charging contact 13. The atomizing device 7 is turned on/off through the power button 12. Power is supplied to the atomizing comb through the charging contact 13.

Further, the comb teeth 4 comprise a base and several teeth connected to the base. The teeth are internally provided with hollow cavities, and the base is provided with several spraying holes. Both the hollow cavities and the spraying holes are in communication with the channel 11. The liquid in the bottle 6 is dispersed into tiny droplets and sprayed out simultaneously from the hollow cavities of the teeth and the spraying holes of the base, via the nozzle 9 and the channel 11. That is, the droplets can be sprayed out through both of the hollow cavities of the teeth and the spraying holes of the base. The droplets are sprayed evenly, in large quantities, and with good effect.

Further, the comb teeth 4 are connected to comb teeth cover 5. The comb teeth 4 are protected by the comb teeth cover 5, and the comb teeth 4 and the channel 11 are kept clean by the comb teeth cover 5.

Further, the main body 3 is connected to a box cover 1 within which the box 2 is located. By opening the box cover 1 and removing the box 2, liquid can be filled into the bottle 6.

Further, the atomizing device 7 is a ceramic atomizing piece, which is low-power consuming. Thus, a compact and portable usage scenario is achieved, and the demand for use anytime and anywhere can be met.

The working principle of the present invention: the bottle 6 containing the liquid constitutes the mist source of the active ingredients of the care solution, cooperating with the cotton core 8 and the ceramic atomizing piece; after being connected to the main body 3, the power is supplied by the main body 3; after the box 2 is connected with the main body 3, the box 2 is in communication with the channel of the main body 3; after turning on the power button 12, the ceramic atomizing piece starts to atomize the liquid which is delivered to the ceramic atomizing piece by the cotton core 8, until the power button 12 is turned off or the liquid atomization is complete; the mist, with the initial kinetic energy provided by the ceramic atomizing piece, reaches the comb teeth 4 through the channel 11, and the droplets are sprayed out simultaneously from the hollow cavities of the several teeth and the several spraying holes of the base; the mist evenly spreads to the place where the comb teeth 4 pass, being delivered deeply and accurately to the target surface; the channel 11 can be of any shape, and it serves to deliver the atomized liquid to the end of the comb teeth 4; the connecting method between the box 2 and the main body 3 is not limited, with the only purpose to realize the connection between the atomizing port and the channel 11; the form of the box 2 is not limited, and it can be integrated with the main body 3, or it can be separated from the main body 3, with the only purpose to achieve atomization of the liquid;

the power supply method is not limited, with the only purpose to provide the corresponding voltage and power for the ceramic atomizing piece; the combination of the movement of the comb teeth 4 and the mist completes the delivery of the active ingredients to the target location, achieving the purpose of making the active ingredients more even and more effectively functional.

The protection scope of the present invention is not limited to the above-mentioned embodiment. Within the spirit and principle of the present invention, any modifications, equivalent replacements and improvements that can be made by those skilled in the art should be included in the protection scope of the present invention.

The invention claimed is:

1. An atomizing comb, comprising:

a main body, wherein the main body is internally provided with a channel for passing mist;

comb teeth, wherein the comb teeth are connected to the main body; and a box for producing the mist, wherein the box is removably connected to an outside of the main body, and the box comprises a bottle and an atomizing device, wherein the bottle is filled with liquid, and the atomizing device is used to disperse the liquid in the bottle into tiny droplets and spray them through the channel and the comb teeth, wherein the box further comprises a cotton core, wherein one end of the cotton core is connected to the bottle, the other end of the cotton core is connected with the atomizing device, and the cotton core is used for transferring the liquid in the bottle to the atomizing device.

2. The atomizing comb according to claim 1, wherein the box further comprises a nozzle, the nozzle is connected to the bottle, and the liquid in the bottle is dispersed into tiny droplets and sprayed out through the nozzle, the channel and the comb teeth.

3. The atomizing comb according to claim 2, wherein the main body is removably connected to the box through a connecting mechanism, and the channel of the main body is in communication with the nozzle.

4. The atomizing comb according to claim 3, wherein the comb teeth comprise a base and several teeth connected to the base, the teeth are internally provided with hollow cavities, and the base is provided with several spraying holes, wherein both the hollow cavities and the spraying holes are in communication with the channel.

5. The atomizing comb according to claim 4, wherein the box further comprises power contacts and positioning magnets.

6. The atomizing comb according to claim 5, wherein the main body further comprises a power button and a charging contact.

7. The atomizing comb according to claim 6, wherein the comb teeth are connected to a comb teeth cover; the main body is connected to a box cover, and the box is located within the box cover.

8. The atomizing comb according to claim 7, wherein the atomizing device is a ceramic atomizing piece.

9. The atomizing comb according to claim 2, wherein the main body is removably connected to the box through a connecting mechanism, and the channel of the main body is in communication with the nozzle.

10. The atomizing comb according to claim 1, wherein the comb teeth comprise a base and several teeth connected to the base, the teeth are internally provided with hollow cavities, and the base is provided with several spraying holes, wherein both the hollow cavities and the spraying holes are in communication with the channel.

11. The atomizing comb according to claim 10, wherein the box further comprises power contacts and positioning magnets.

12. The atomizing comb according to claim 11, wherein the main body further comprises a power button and a charging contact.

13. The atomizing comb according to claim 12, wherein the comb teeth are connected to a comb teeth cover; the main body is connected to a box cover, and the box is located within the box cover.

14. The atomizing comb according to claim 13, wherein the atomizing device is a ceramic atomizing piece.

* * * * *